US009535447B2

(12) United States Patent
Vogt

(10) Patent No.: US 9,535,447 B2
(45) Date of Patent: Jan. 3, 2017

(54) ROTARY/PUSH OPERATING DEVICE FOR A MAN-MACHINE INTERFACE

(75) Inventor: Frank Vogt, Lichtenau (DE)

(73) Assignee: BEHR-HELLA THERMOCONTROL GMBH, Stuttgart (DE)

( * ) Notice: Subject to any disclaimer, the term of this patent is extended or adjusted under 35 U.S.C. 154(b) by 393 days.

(21) Appl. No.: 13/978,567

(22) PCT Filed: Nov. 30, 2011

(86) PCT No.: PCT/EP2011/071414

§ 371 (c)(1),
(2), (4) Date: Jul. 8, 2013

(87) PCT Pub. No.: WO2012/093005

PCT Pub. Date: Jul. 12, 2012

(65) Prior Publication Data

US 2013/0276572 A1 Oct. 24, 2013

(30) Foreign Application Priority Data

Jan. 8, 2011 (DE) ..... 10 2011 008 152

(51) Int. Cl.
*G05G 1/02* (2006.01)
*G05G 1/10* (2006.01)
(Continued)

(52) U.S. Cl.
CPC *G05G 1/10* (2013.01); *G05G 1/02* (2013.01); *G05G 1/08* (2013.01); *G05G 1/105* (2013.01);
(Continued)

(58) Field of Classification Search
CPC ..... Y10T 74/2084; Y10T 74/20846; Y10T 74/20852; Y10T 74/20244; G05G 1/02; G05G 1/08; G05G 1/10; G05G 1/105; G05G 1/12; H01H 3/08; H01H 3/12; H01H 9/16; H01H 9/165; H01H 13/14; H01H 13/50; H01H 13/58; H01H 13/585; H01H 25/06; H01H 25/065
See application file for complete search history.

(56) References Cited

U.S. PATENT DOCUMENTS

2002/0001419 A1* 1/2002 Nakajima ..... F16C 29/04 384/49
2004/0007450 A1* 1/2004 Kojima et al. ..... 200/564
2006/0096845 A1 5/2006 Zegula

FOREIGN PATENT DOCUMENTS

DE 10212992 A1 3/2002
DE 10261284 A1 7/2004
(Continued)

OTHER PUBLICATIONS

International Search Report with Written Opinion for corresponding PCT/EP2011/071414 dated Feb. 29, 2012.

*Primary Examiner* — Richard W Ridley
*Assistant Examiner* — Brian McGovern
(74) *Attorney, Agent, or Firm* — Renner, Otto, Boisselle & Sklar, LLP

(57) ABSTRACT

A rotary/push operating device (10) for a man-machine interface, in particular for an operating unit of a vehicle, comprises a manually operable rotary/push element (12) which can be rotated about a rotational axis (15) and which can be pushed down in the direction of the rotational axis (15), and a rolling-body bearing (14) which defines the rotational axis (15) and which comprises a immobile bearing ring (18), a movable bearing ring (20), and a rolling-body cage (22) arranged between said bearing rings. The rotary/push element (12) is coupled to the movable bearing ring (20) in such a manner that the rotary/push element (12) will move together with the movable bearing ring (20) when, during rotation of the rotary/push element (12), the movable bearing ring (20) rotates or is axially moved in the direction of the rotational axis (15).
The rolling-body cage (22) comprises a plurality of rolling bodies (24) arranged in at least one radial plane of the rolling-body cage (22). The immobile bearing ring (18) and the movable bearing ring (20) form at least one circular moving channel (27,28) in which the rolling bodies (24),
(Continued)

during rotation of the rotary/push element (12) in the circumferential direction of the two bearing rings (18,20), are movable with rolling movements on opposite moving tracks (29,30,31,32) of the two bearing rings (18,20), and, when the rotary/push element (12) is being pushed down in the direction of the rotational axis (15), can move on the moving tracks (29,30,31,32) at a right angle relative to said circumferential direction.

For limiting the movement of the rotary/push element (12) in the direction of the rotational axis (15) between a base position and a push-down position, the rotary/push operating device (10) further comprises end abutment elements (45).

8 Claims, 3 Drawing Sheets

(51) Int. Cl.
*G05G 1/08* (2006.01)
*G05G 1/12* (2006.01)
*H01H 9/16* (2006.01)
*H01H 13/58* (2006.01)

(52) U.S. Cl.
CPC ..... *G05G 1/12* (2013.01); *H01H 9/16* (2013.01); *H01H 9/165* (2013.01); *H01H 13/58* (2013.01); *H01H 13/585* (2013.01); *Y10T 74/2084* (2015.01)

(56) References Cited

FOREIGN PATENT DOCUMENTS

| | | | | |
|---|---|---|---|---|
| EP | 0282817 A1 | | 9/1988 | |
| FR | 2837582 | | 3/2003 | |
| GB | 1559730 | * | 1/1980 | ..... F16C 19/166 |

* cited by examiner

ROTARY/PUSH OPERATING DEVICE FOR A MAN-MACHINE INTERFACE

FIELD OF THE INVENTION

The invention relates to a rotary/push operating device for a man-machine interface, in particular for an operating unit of a vehicle.

Rotary/push operating devices for data input within a vehicle via a so-called man-machine interface and respectively for operating units of a vehicle are known in the state of the art. In the normal case, a rotary/push operating device is provided with a rotary/push element. By rotating the rotary/push element, one can select letters, symbols or functions, and these will be confirmed by pressing. After confirmation of such an input, a task corresponding to the input will be carried out.

BACKGROUND OF THE INVENTION

From DE-A-102 61 284, a rotary operating element is known which upon application of a force can be moved along its rotational axis. Said operating element comprises a toothed portion arranged in engagement with a gear so that the rotation of the operating element will be transmitted onto the gear. In this configuration, the rotational axis of the gear is disposed parallel to, and laterally of, the rotational axis of the operating element. This measure allows for a movement of the operating element along its rotational axis. Said toothed portion preferably forms a gear itself, thus allowing for a full rotation of the operating element. However, a disadvantage of this known operating element resides in that the rotation and the movement of the operating element in the axial direction are realized by the cooperation of a plurality of gears and the construction will thus be overly complex.

Known from DE-A-102 12 992 is a rotary operating element comprising a immobile inner portion and a rotatable ring element and respectively sleeve element as an outer portion, the latter being supported on said inner portion by means of a rolling bearing.

SUMMARY OF THE INVENTION

It is an object of the invention to provide a rotary/push operating device for a man-machine interface, wherein the rotary/push operating device is provided with a simple and failure-free construction for moving a rotary/push element in two orthogonal directions.

According to the invention, for achieving the above object, there is proposed a rotary/push operating device comprising

- a manually operable rotary/push element which can be rotated about a rotational axis and which can be pushed down in the direction of the rotational axis,
- a rolling-body bearing, which defines the rotational axis and which comprises a immobile bearing ring, a movable bearing ring, and a rolling-body cage arranged between said bearing rings,
- the rotary/push element being tightly coupled to the movable bearing ring,
- the rolling-body cage comprising a plurality of rolling bodies arranged in at least one radial plane of the rolling-body cage, and
- the immobile bearing ring and the movable bearing ring forming at least one circular moving channel in which the rolling bodies, upon rotation of the rotary/push element, are movable in the circumferential direction of the two bearing rings with rolling movements on opposite moving tracks of the two bearing rings, and, when the rotary/push element is being pushed, are movable in the direction of the rotational axis on the moving tracks at a right angle relative to said circumferential direction, and
- end abutment elements for limiting the movement of the rotary/push element in the direction of the rotational axis between a base position and a push-down position.

The rotary/push operating device according to the invention is provided with a manually actuated rotary/push element which, by means of a rolling bearing, is supported for rotation about a rotational axis, said rotary/push element additionally being adapted to be pressed down in the direction of the rotational axis and to be moved back. Said rolling bearing comprises a immobile bearing ring, a movable bearing ring, and a rolling-body cage arranged between said bearing rings, wherein the rotary/push element is coupled to the movable bearing ring in such a manner that the rotary/push element will move together with the movable bearing ring when, during rotation of the rotary/push element, the movable bearing ring rotates or is axially moved in the direction of the rotational axis. The rolling-body cage is provided with a plurality of rolling bodies arranged in at least one radial plane. The rolling bodies move in a circular moving channel formed by the immobile bearing ring and the movable bearing ring. In this moving channel, the rolling bodies, during rotation of the rotary/push element, are movable in the circumferential direction of the two bearing rings with rolling movements on opposite moving tracks of the two bearing rings, and, when the rotary/push element is being pushed down, they are movable in the direction of the rotational axis on the moving tracks at a right angle relative to said circumferential direction. Thus, the rolling bodies are arranged to "float" in the axial direction between the moving tracks. A constructional simplification of the rotary/push operating device of the invention is to be seen in that the movement of the rotary/push element in two orthogonal directions is realized exclusively by a rolling bearing.

For limiting the movement of the rotary/push element in the direction of the extension of the rotational axis between a base position and a push-down position, the rotary/push operating device of the invention comprises end abutment elements.

The end abutment elements can be designed in various forms. For instance, the end abutment elements can consist of two flanges which radially project from the immobile bearing ring and are axially spaced, and an abutment projection projecting from the movable bearing ring and extending between the two flanges. In this case, the base position and the push-down position of the rotary/push element is defined by abutment of the abutment projection on respectively one of said flanges. The arrangement of the flanges and of the abutment projection on the bearing rings can also be inversed.

Alternatively, an abutment projection on the rotary/push element can also cooperate e.g. with other elements of the operating device such as e.g. a front cover and a plate (circuit board) supporting the rotary/push element, so as to define the base and push-down positions.

According to the invention, the moving channel comprises, in the direction of the extension of the rotational axis, two ends where the distance between the two moving tracks can be reduced. In order to allow the rolling bodies to roll on the two opposite moving tracks, the distance between the moving tracks is substantially identical to the dimension of a rolling body in the radial direction of the two bearing rings. If this distance is reduced on the two ends of the moving channel, the rolling bodies cannot enter the tapered ends of the moving channel. Thus, the reduced distances on the ends of the moving tracks will form end abutment elements.

As a further variant of the invention, it can be provided that the rolling bodies are substantially cylindrical bodies (e.g. with cylindrical or spherical peripheral surface). When the rotary/push element will be moved in the direction of the rotational axis (e.g. when the rotary/push element is pushed down), said cylindrical bodies will be displaced on the opposite moving tracks of the two bearing rings.

Preferably, the rolling bodies are balls. This has the advantage that the balls can move by rolling on the moving tracks both in the circumferential direction of the two bearing rings and in the direction of the rotational axis. Thus, also a movement of the rotary/push element in the direction of the extension of the rotational axis will cause a rolling movement instead of a sliding movement between the rolling body balls and the moving tracks.

For preventing wear of the bearing as caused e.g. by the tilting moment acting on the rotary/push element, various embodiments of the rolling bodies and respectively the rolling body cage are possible. In this regard, it is provided according to an advantageous embodiment of the invention that the rolling bodies are arranged in two mutually spaced radial planes of the rolling body cage. Thus, the rotary/push element is supported, in the direction of the extension of the rotational axis, via two mutually spaced groups of rolling bodies. Thereby, a possible undesired tilting of the rotary/push element can be prevented. As a result, the stability of the rotary/push operating device is enhanced.

It is suitable that, by means of a resetting element, the rotary/push element can be automatically reset from its push-down position to its base position. Said resetting element can be e.g. an elastic element of a random design. By pressing down the rotary/push element into the push-down position, the resetting element will be biased to a farther extent. Once the rotary/push element has been released, it can be reset into its base position by the restoring force of the resetting element.

The rotary/push element of the invention is suitably provided with at least one sensor for detection of a rotary movement and/or the present rotary position of the rotary/push element, and with at least one second sensor for detection of the push-down position of the rotary/push element.

BRIEF DESCRIPTION OF THE DRAWINGS

The invention will be described hereunder in greater detail by way of an exemplary embodiment with reference to the drawing. In the individual Figures of the drawing, the following is shown.

DETAILED DESCRIPTION OF THE INVENTION

Figure 1:
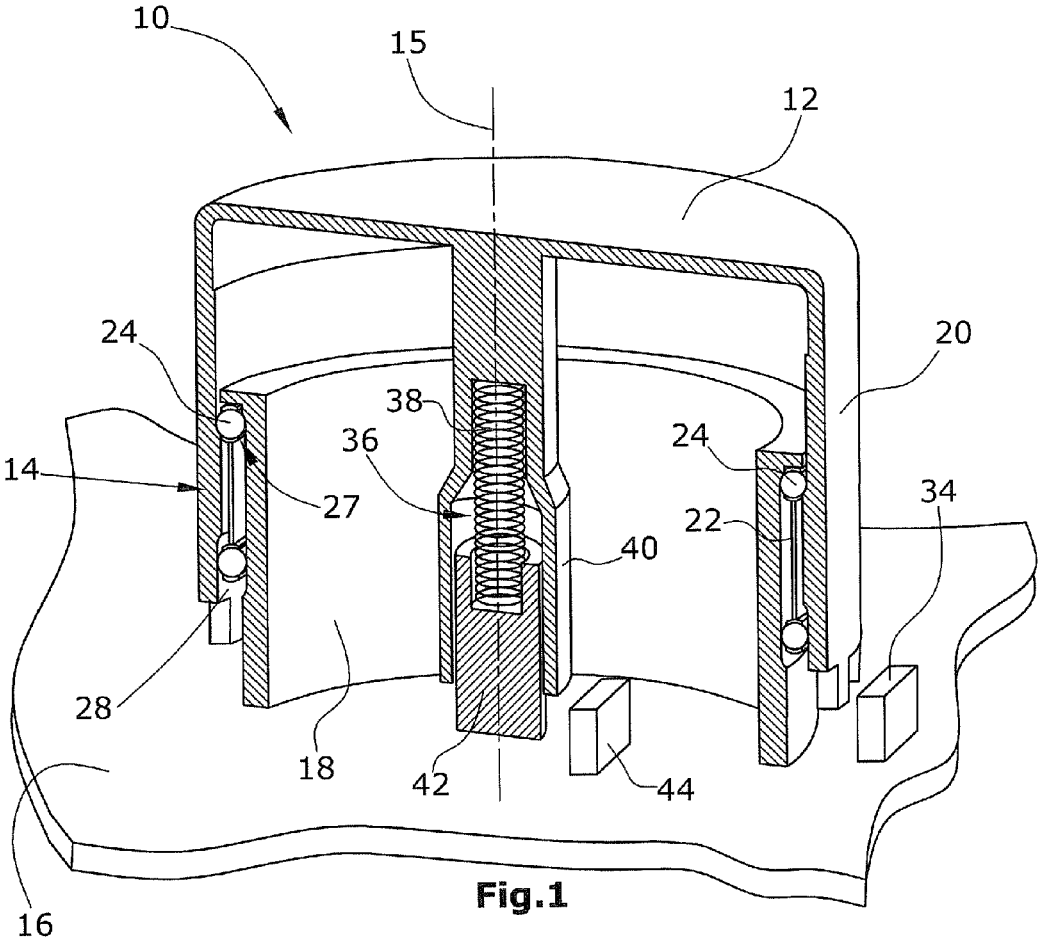
FIG. 1 is a partially sectional perspective view of a rotary/push operating device.

In FIG. 1, there is shown, partially in sectional view, a rotary/push operating device 10 comprising a rotary/push element 12 and a rolling-body bearing 14 formed as a ball bearing, said rotary/push element 12 being adapted to rotate in its circumferential direction about a rotational axis 15 and to move along said rotational axis 15. Said rolling body bearing 14 comprises a bearing ring 18 fixed to a support plate 16 (formed e.g. as a circuit board), a movable bearing ring 20 and, arranged therebetween, a rolling body cage 22 including rolling bodies 24, wherein said movable bearing ring 20 surrounds said immobile bearing ring 18 or is arranged inside the latter. In the present embodiment, the movable bearing ring 20 is formed integrally with the rotary/push element 12. Thus, the movable bearing ring 20 will follow the manually induced movement of the rotary/push element 12, both when the latter is rotated in the circumferential direction and during movement in the direction of rotational axis 15.

Said rolling bodies 24 of rolling body cage 22 are balls 25,26. For improving the stability of rolling-body bearing 14, the balls 25,26 are rotatably arranged in two mutually spaced radial planes of rolling body cage 22. Suitably, in the movable bearing ring 20 and the immobile bearing ring 18, there are formed, for the balls 25,26 distributed in two planes, two corresponding circular moving channels 27,28, notably an upper moving channel 27 and a lower moving channel 28. Said upper moving channel 27 comprises two opposite moving tracks 29,30, wherein the moving track 29 is formed by immobile bearing ring 18 and the moving track 30 is formed by movable bearing ring 20. In a manner similar to upper moving channel 27, also lower moving channel 28 is provided with two moving tracks 31,32 formed on the two bearing rings. Both when the rotary/push element 12 is rotated in its circumferential direction and when the rotary/push element 12 is pressed down along the rotational axis 15, the balls 25,26 can roll on the respective moving tracks 29,20,31,32. The cooperation of the balls 25,26 and of the moving tracks 29 to 32 will be explained in greater detail with reference to FIGS. 4 and 5.

For detecting the rotary position of rotary/push element 12, a first sensor 34, e.g. an optically functioning rotary-position sensor, is arranged on the support plate 16, said sensor detecting the rotary position of rotary/push element 12.

For automatic reset of the rotary/push element 12 from its push-down position into its base position, the rotary/push operating device 10 further comprises a resetting element 36. As shown in FIG. 1, the rotary/push operating device 10 is provided with a resetting spring 38 serving as a resetting element 36. When the rotary/push element 12 is pressed down, the resetting spring 38 will be compressed between a shell 40 formed on rotary/push element 12 and a spring holding element 42 projecting from the support plate 16.

For detecting whether the rotary/push element 12 has reached its pushdown position, the rotary/push operating device 10 comprises a second sensor 44. This sensor 44 can be arranged e.g. for detecting the movement of the shell 40 within the two bearing rings 18,20 (as shown in FIG. 1) or for detecting the movement of the movable bearing ring 20 outside the two bearing rings 18,20.

Figure 2:
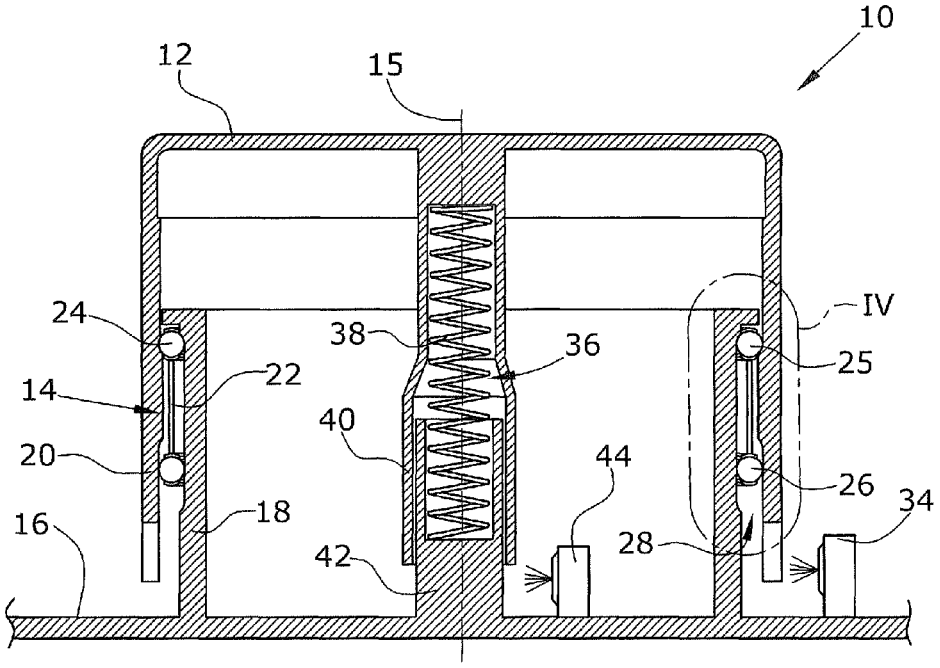
FIG. 2 is a sectional view of the rotary/push operating device in the state where the rotary/push element thereof is in its base position.

FIG. 2 shows a sectional view of the rotary/push operating device 10 in the state wherein the rotary/push element 12 thereof is in its base position. As can be seen in FIG. 2, the rotary/push element 12 is biased into this base position by the resetting spring 38. The rotary/push element 12 is rotatable e.g. for selecting a desired function from a menu of a user surface of a man-machine interface. Its rotational position or movement is detected by the first sensor 34. For activating the desired function, the rotary/push element 12 will be manually pressed down in the direction of its rotational axis 15 all the way to its push-down position. When the push-down position has been reached, this will be detected by the second sensor 44.

Figure 3:
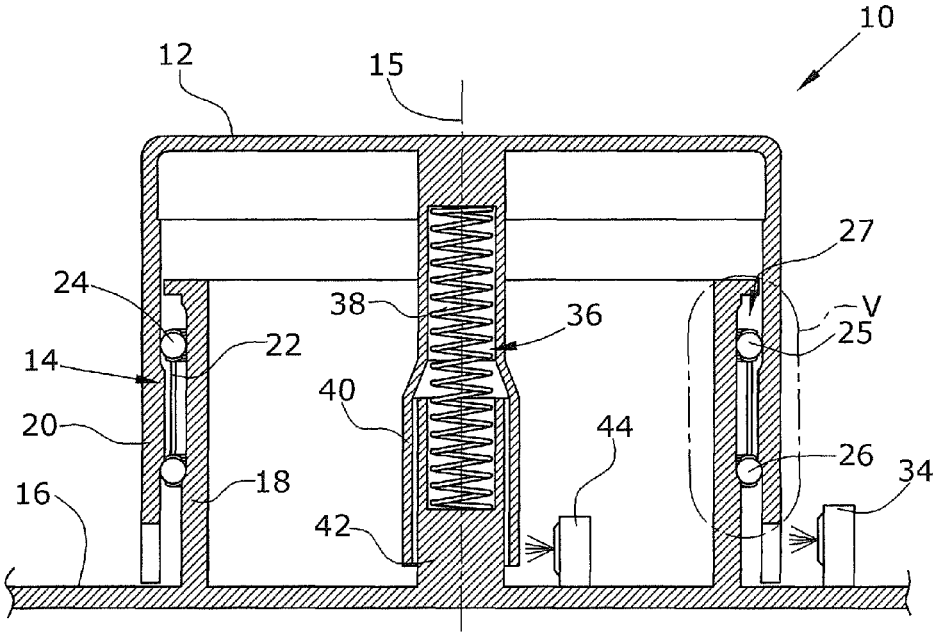
FIG. 3 is a sectional view of the rotary/push operating device in the state where the rotary/push element thereof is in its push-down position.

The state of the rolling-body bearing 14 in the base position (FIG. 2) and in the push-down position (FIG. 3) of the rotary/push element 12 will be explained in greater detail with reference to FIG. 4 and respectively FIG. 5.

Figure 4:
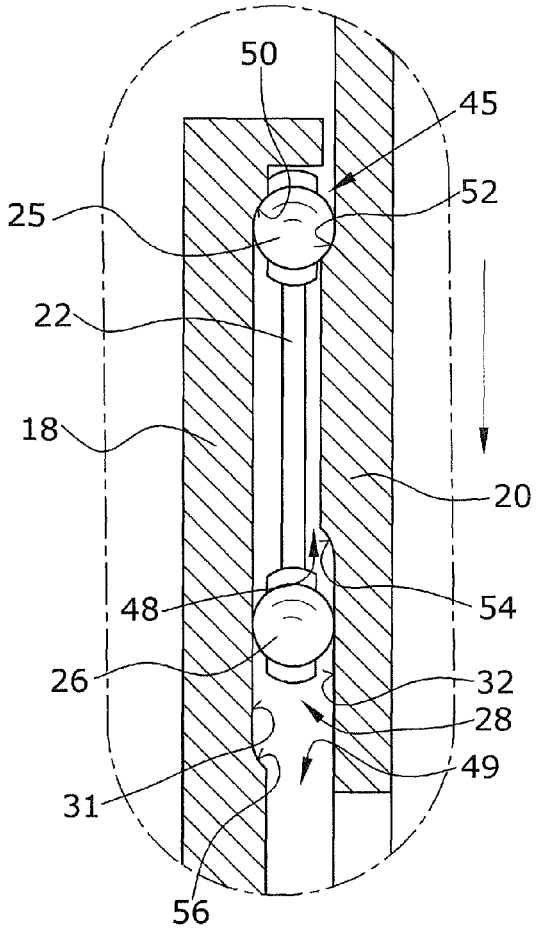
FIG. 4 is an enlarged view of the area marked by IV in FIG. 2.
Figure 5:
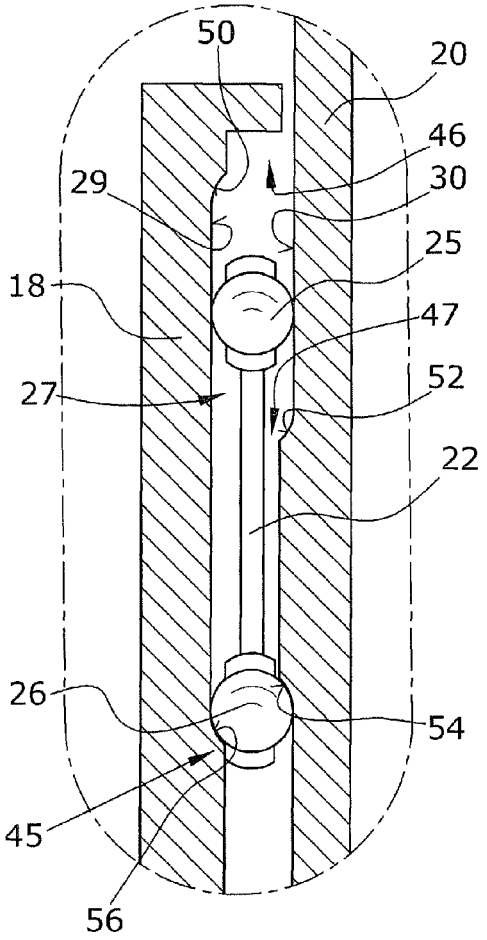
FIG. 5 is an enlarged view of the area marked by V in FIG. 3.

As depicted in FIGS. 4 and 5, said balls 25,26 are arranged in the upper moving channel 27 and respectively the lower moving channel 28 when the rotary/push element 12 is pressed. The movement of the rotary/push element 12 in the direction of the rotational axis 15 between the base position and the push-down position is limited by end abutment elements 45. The function of the end abutment elements 45 can be realized by various options. One measure is illustrated in FIGS. 4 and 5. As shown in FIGS. 4 and 5, the upper moving channel 27 comprises, in the direction of the rotational axis 15, two ends, notably an upper end 46 and a lower end 47, at which the distance between the two confronting moving tracks 29,30 is reduced, thus forming mutually averted narrowed ends 46 and 47 of the upper moving channel 27. In the same manner, the lower moving channel 28 comprises two mutually averted narrowed ends 48 and 49.

When the rotary/push element 12 is moved in the manner provided, i.e. is rotated or pressed down, the balls 25 and 26 are arranged in the widened middle regions of the upper and lower moving channels 27 and 28. Between these widened regions and the respective upper and lower ends 46, 47, 48 and 49 of the two moving channels 27 and 28, the moving tracks 29, 30, 31 and 32 comprise concave transition curves 50, 52, 54 and 56. These transition curves 50, 52, 54 and 56, as shown in FIGS. 4 and 5, can be formed alternately on the mutually opposite moving tracks 29, 30, 31 and 32. Thus, at the lower end 47 of moving channel 27, namely on the lower end of moving track 30, there is formed a transition curve 52. The transition curve 50 is arranged on the upper end 46 of upper moving channel 27, namely on the upper end of moving track 29 of the immobile bearing ring 18.

As illustrated in FIG. 4, the upper balls 25, due to the fact that the transition curves 50 and 52 are in abutment on the balls 25, put a limit to a further movement of the rotary/push element 12 beyond the base position (FIG. 4). In the same manner, the lower balls 26, by having the transition curves 54 and 56 abutting on them, put a limit to a further movement of the rotary/push element 12 beyond the push-down position (FIG. 5). By the above described cooperation of the balls and the transition curves, the functions of the end abutment elements 45 are realized.

LIST OF REFERENCE NUMERALS

10 rotary/push operating device
12 rotary/push element
14 rolling-body bearing
15 rotational axis of the rotary/push element
16 support plate
18 immobile bearing ring
20 movable bearing ring
22 rolling-body cage
24 rolling body
25 balls in the upper radial plane of the rolling-body cage
26 balls in the lower radial plane of the rolling-body cage
27 upper moving channel of rolling bearing
28 lower moving channel of rolling bearing
29 upper moving path of the immobile bearing ring
30 upper moving path of the movable bearing ring
31 lower moving path of the immobile bearing ring
32 lower moving path of the movable bearing ring
34 first sensor (rotary sensor)
35 resetting element
38 resetting spring
40 shell
42 spring holding element
44 second sensor (press-down sensor)
45 end abutment element
46 upper end of the upper moving channel
47 lower end of the upper moving channel
48 upper end of the lower moving channel
49 lower end of the lower moving channel
50 upper transition curve in the upper moving channel
52 lower transition curve in the upper moving channel
54 upper transition curve in the lower moving channel
56 lower transition curve in the lower moving channel

The invention claimed is:

1. A rotary/push operating device for a man-machine interface, for an operating unit of a vehicle, comprising:

a manually operable rotary/push element which can be rotated about a rotational axis and which can be pushed down in a direction parallel to the rotational axis, a rolling-body bearing defining the rotational axis, said rolling-body bearing comprising an immobile bearing ring, a movable bearing ring, and a rolling-body cage arranged between said bearing rings, the rotary/push element being tightly coupled to the movable bearing ring, the rolling-body bearing having a first plurality of rolling bodies and a second plurality of rolling bodies, the second plurality of rolling bodies axially spaced from the first plurality of rolling bodies, the rolling-body cage extending from the first plurality of rolling bodies to the second plurality of rolling bodies, and the immobile bearing ring and the movable bearing ring forming at least one circular moving channel in which the first and second pluralities of rolling bodies, upon rotation of the rotary/push element, are movable in a circumferential direction of the two bearing rings with rolling movements on a moving track formed by the immobile bearing ring and a moving track formed by the movable bearing ring that are located on opposite sides of the at least one circular moving channel and each have a respective length greater than a respective diameter of each rolling body of the first and second pluralities of rolling bodies that extends in the direction parallel to the rotational axis, whereby when the rotary/push element is being pushed, the first and second pluralities of rolling bodies are movable in the direction parallel to the rotational axis on the moving tracks at a right angle relative to said circumferential direction, and wherein each rolling body of the first and second pluralities of rolling bodies has a center of mass that is axially displaceable along the moving track of the immobile bearing ring and the moving track of the movable bearing ring, and end abutment elements for limiting the movement of the rotary/push element in the direction parallel to the rotational axis between a base position and a push-down position.

2. The rotary/push operating device according to claim 1, wherein during movement of the rotary/push element between the base position and the push-down position, wherein the moving track formed by the immobile bearing ring and the moving track formed by the movable bearing ring are displaceable relative to each other in the direction parallel to the rotational axis.

3. The rotary/push operating device according to claim 1, wherein in the direction parallel to the rotational axis, the at least one circular moving channel has two ends on which the distance between the moving track formed by the immobile bearing ring and the moving track formed by the movable bearing ring is reduced for forming the end abutment elements.

4. The rotary/push operating device according to claim 1, wherein each rolling body of the first and second pluralities of rolling bodies is a substantially cylindrical body which during movement of the rotary/push element in the direction parallel to the rotational axis is displaceable along the moving track formed by the immobile bearing ring and the moving track formed by the movable bearing ring.

5. The rotary/push operating device claim 1, wherein each rolling body of the first and second pluralities of rolling bodies is a ball which during movement of the rotary/push element in the direction parallel to the rotational axis is movable by rolling on the moving track formed by the immobile bearing ring and the moving track formed by the movable bearing ring.

6. The rotary/push operating device according to claim 1, wherein the rotary/push element is automatically resettable from the push-down position into the base position by a resetting element.

7. The rotary/push operating device according to claim 1, further comprising a first sensor for detecting a rotational movement and/or the current rotary position of the rotary/push element.

8. The rotary/push operating device claim according to claim 7, further comprising a second sensor for detecting the push-down position of the rotary/push element.

* * * * *